US010029169B2

(12) United States Patent
Jimenez et al.

(10) Patent No.: US 10,029,169 B2
(45) Date of Patent: Jul. 24, 2018

(54) BILLIARD CHALKING ASSEMBLY

(71) Applicants: Fabian Jimenez, Monrovia, CA (US); Alex Jimenez, Monrovia, CA (US)

(72) Inventors: Fabian Jimenez, Monrovia, CA (US); Alex Jimenez, Monrovia, CA (US)

( * ) Notice: Subject to any disclaimer, the term of this patent is extended or adjusted under 35 U.S.C. 154(b) by 0 days.

(21) Appl. No.: 15/376,199

(22) Filed: Dec. 12, 2016

(65) Prior Publication Data

US 2018/0161662 A1 Jun. 14, 2018

(51) Int. Cl.
*A63D 15/16* (2006.01)
*A63D 15/00* (2006.01)

(52) U.S. Cl.
CPC ..... *A63D 15/16* (2013.01); *A63D 15/00* (2013.01)

(58) Field of Classification Search
CPC ..... A63D 15/16; A63D 15/00
USPC ..... 473/35–39, 1; D21/782; 224/250, 224/267–269
See application file for complete search history.

(56) References Cited

U.S. PATENT DOCUMENTS 497,886 A * 5/1893 Munro ..... A63D 15/16 473/36
552,171 A 12/1895 Farnham
574,501 A * 1/1897 Tassinari ..... A63D 15/16 473/36
601,779 A 4/1898 Roberts
635,569 A * 10/1899 Miller ..... A63D 15/16 473/36
639,427 A * 12/1899 McLarty ..... A63D 15/16 473/36
744,935 A * 11/1903 Pejchar ..... A63D 15/16 473/36
965,444 A * 7/1910 Dahl ..... A63D 15/16 473/36
1,097,088 A 5/1914 Gilbert
1,332,431 A * 3/1920 Darras ..... A63D 15/16 473/38
1,453,877 A * 5/1923 Johnson ..... A63D 15/16 473/38
1,957,549 A * 5/1934 Matteson ..... A63D 15/16 473/36
3,323,798 A * 6/1967 Miller ..... A63D 15/16 446/396
3,843,120 A * 10/1974 Ricci ..... A63D 15/006 473/36
D239,298 S * 3/1976 Turner ..... D11/35
4,060,243 A * 11/1977 Langan ..... A63D 15/16 473/36
4,341,331 A * 7/1982 McDougall ..... A45C 1/04 224/219
4,403,366 A * 9/1983 Lucke ..... A41D 13/0015 15/209.1
D273,315 S * 4/1984 Matteson ..... D21/782
(Continued)

FOREIGN PATENT DOCUMENTS

CA 2333863 A1 * 8/2002 ..... A63D 15/00
DE 4321950 A1 * 1/1994 ..... A63D 15/16

*Primary Examiner* — Mitra Aryanpour

(57) ABSTRACT

A billiard chalking assembly for applying billiard chalk to a billiard cue includes bracelet that is worn around a wrist. A ball is provided and a billiard chalk is positioned in the ball. The ball is removably coupled to the bracelet thereby facilitating the billiard chalk to be accessible to a wearer of the bracelet. The ball is manipulated to facilitating the billiard chalk to chalk a billiard cue.

5 Claims, 4 Drawing Sheets

(56) References Cited

U.S. PATENT DOCUMENTS 4,500,019 A * 2/1985 Curley, Jr. ..... A45F 5/00 224/222
4,504,980 A * 3/1985 Butcher ..... A41D 13/081 2/160
4,690,316 A * 9/1987 Peterson ..... A45F 5/02 224/270
4,733,808 A * 3/1988 Turner, Jr. ..... A01M 31/004 224/219
4,877,242 A * 10/1989 James ..... A63D 15/08 2/161.1
4,953,770 A * 9/1990 Bond, Sr. ..... A63D 15/16 224/250
5,328,411 A 7/1994 Thornton, II
5,433,359 A * 7/1995 Flowers ..... A45F 5/00 224/222
D364,910 S * 12/1995 Shovek ..... D21/782
5,503,316 A * 4/1996 Stewart ..... B60R 7/14 224/312
5,545,093 A * 8/1996 Contestabile ..... A63D 15/00 473/36
D396,895 S * 8/1998 Berry ..... D21/782
D435,911 S 1/2001 Yeager
6,168,057 B1 * 1/2001 Schwabe ..... A45F 5/02 224/269
6,520,863 B2 2/2003 Porper
7,544,133 B1 * 6/2009 Page ..... A63D 15/16 473/35
7,846,145 B2 * 12/2010 Carstens ..... A41D 13/005 604/385.01
8,083,602 B2 * 12/2011 Contestabile ..... A63D 15/12 30/494
8,099,794 B2 * 1/2012 Carstens ..... G06F 1/163 2/16
9,468,243 B2 * 10/2016 Rothschild ..... A41D 13/08 2/16
2005/0107178 A1 * 5/2005 Anderson ..... A63D 15/16 473/36
2012/0234040 A1 9/2012 Murphy

* cited by examiner

BILLIARD CHALKING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to chalking devices and more particularly pertains to a new chalking device for applying billiard chalk to a billiard cue.

BRIEF SUMMARY OF THE INVENTION

An embodiment of the disclosure meets the needs presented above by generally comprising a bracelet that is worn around a wrist. A ball is provided and a billiard chalk is positioned in the ball. The ball is removably coupled to the bracelet thereby facilitating the billiard chalk to be accessible to a wearer of the bracelet. The ball is manipulated to facilitating the billiard chalk to chalk a billiard cue.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
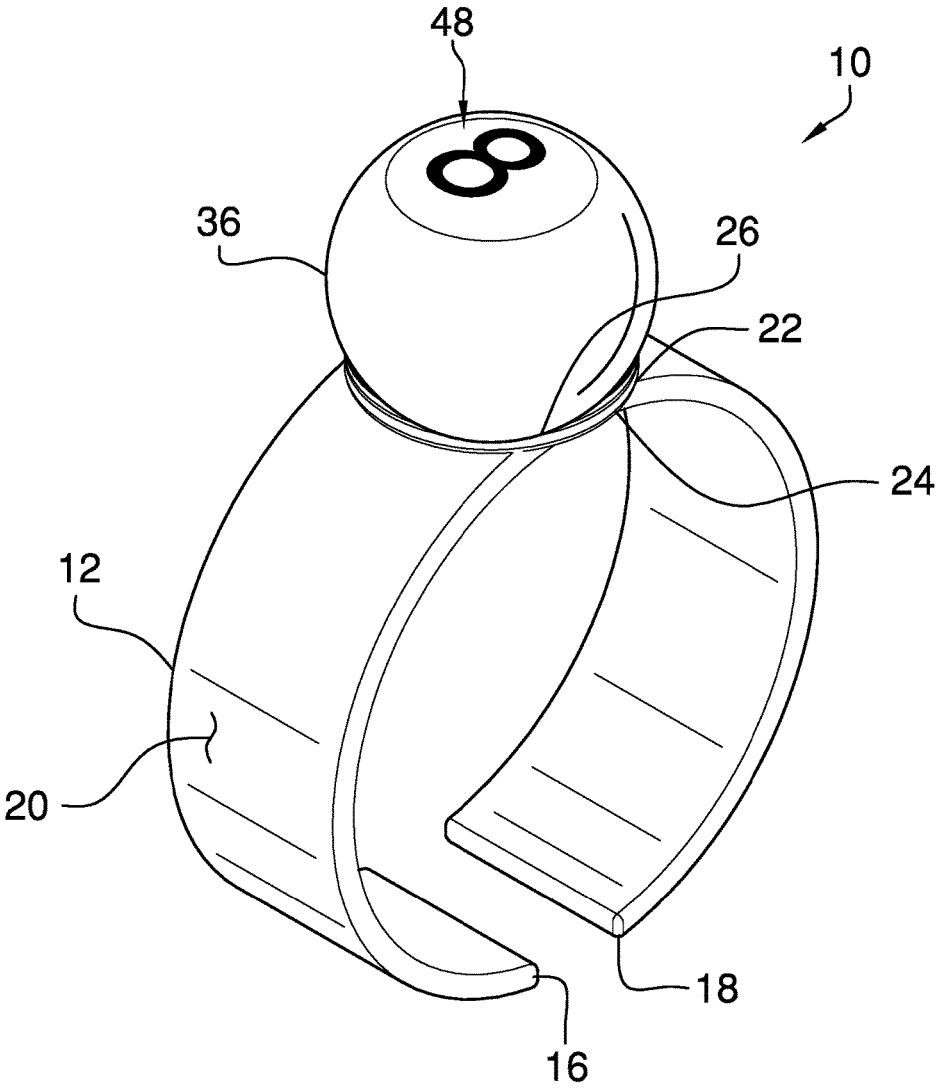
FIG. 1 is a top perspective view of a billiard chalking assembly according to an embodiment of the disclosure.
Figure 2:
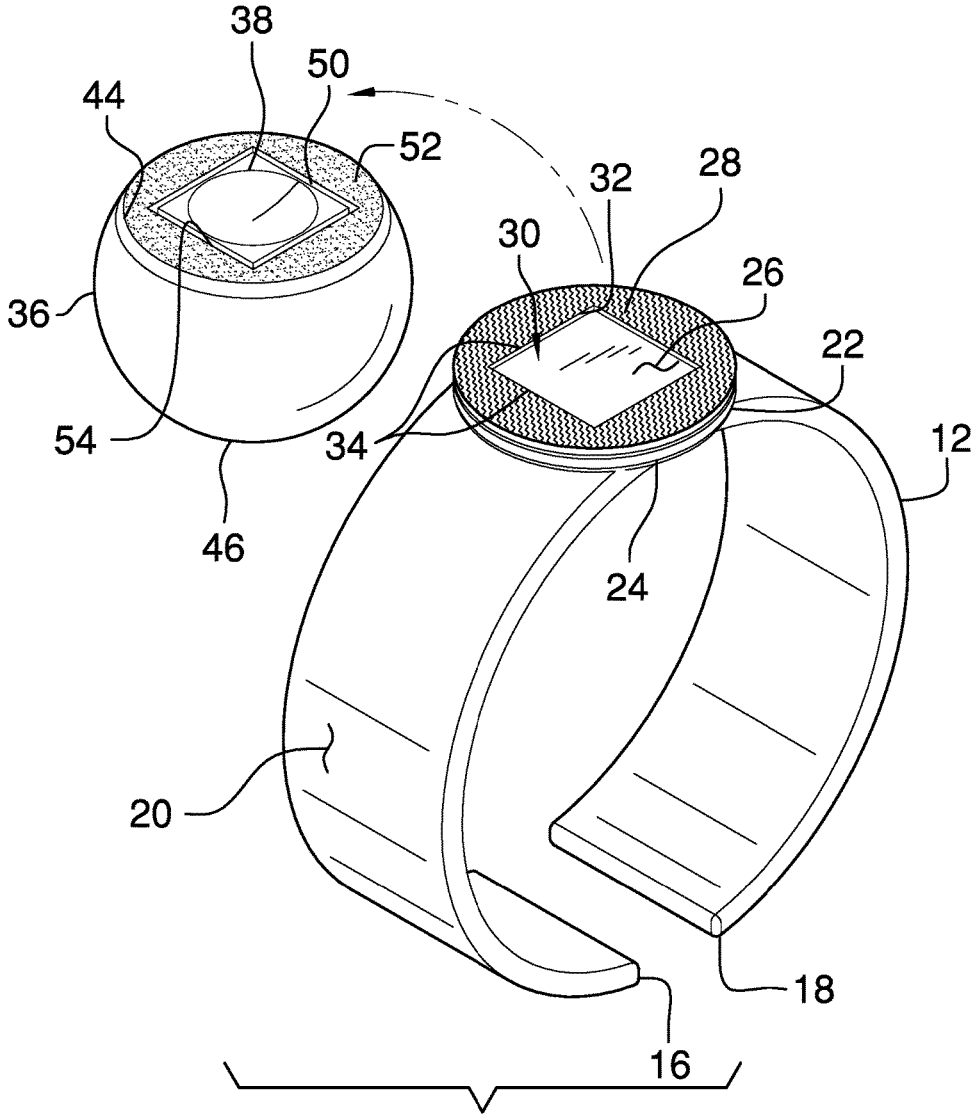
FIG. 2 is an exploded perspective view of an embodiment of the disclosure.
Figure 3:
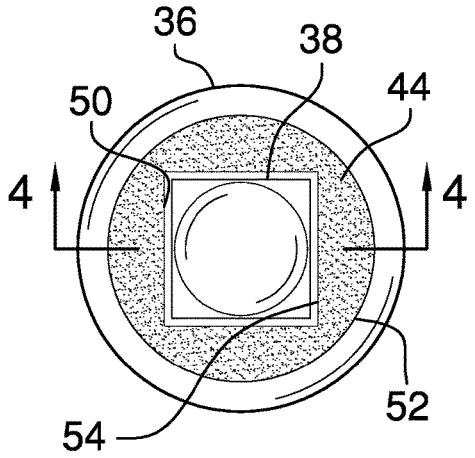
FIG. 3 is a bottom view of a ball of an embodiment of the disclosure.
Figure 4:
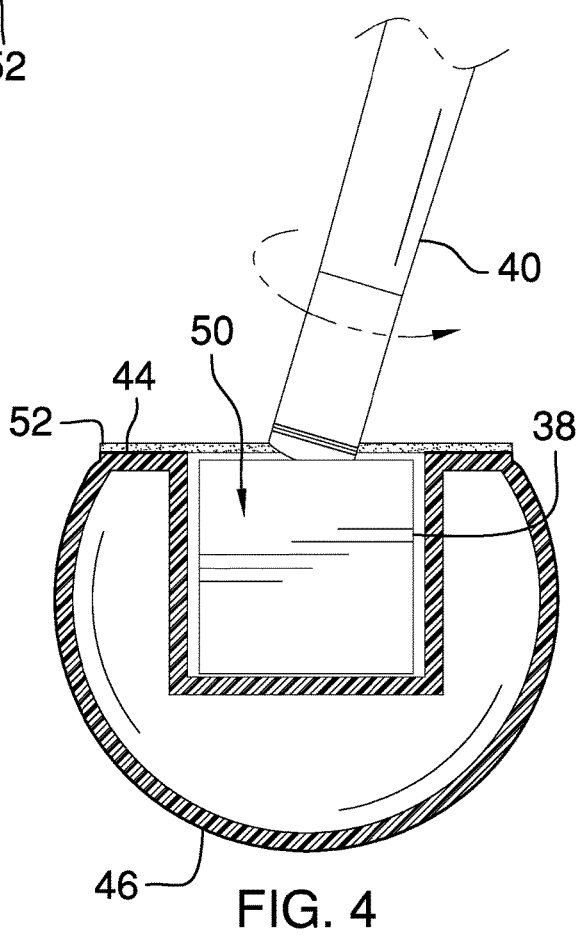
FIG. 4 is a cross sectional view taken along line 4-4 of FIG. 3 of an embodiment of the disclosure.
Figure 5:
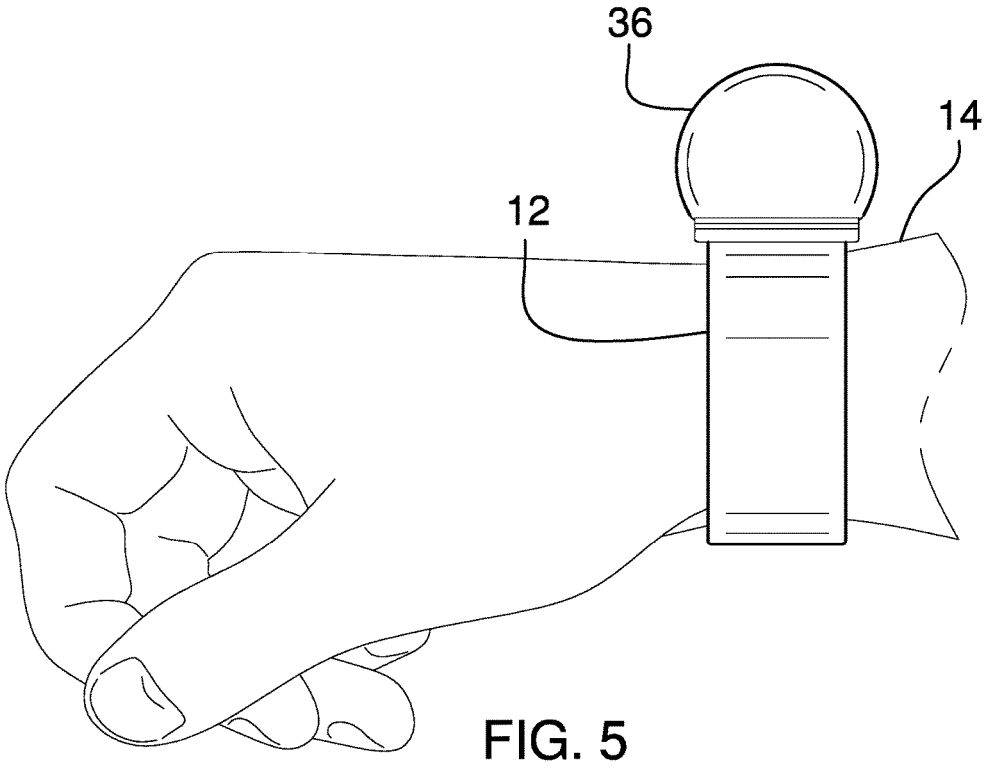
FIG. 5 is a perspective in-use view of an embodiment of the disclosure.

With reference now to the drawings, and in particular to FIGS. 1 through 5 thereof, a new chalking device embodying the principles and concepts of an embodiment of the disclosure and generally designated by the reference numeral 10 will be described.

As best illustrated in FIGS. 1 through 5, the billiard chalking assembly 10 generally comprises a bracelet 12 that may be worn around a wrist 14. The bracelet 12 has a first end 16, a second end 18 and a first surface 20 extending therebetween. The bracelet 12 is curved between the first end 16 and the second end 18 having the first end 16 being spaced from the second end 18. The bracelet 12 is comprised of a resiliently bendable material thereby facilitating the first end 16 to be urged away from the second end 18. In this way the bracelet 12 may be positioned around the wrist 14.

A disk 22 is provided that has a first surface 24 and a second surface 26. The first surface 22 of the disk 22 is coupled to the first surface 20 of the bracelet 12. Moreover, the disk 22 is centrally positioned between the first end 16 and the second end 18. A first mating member 28 is coupled to the second surface of the disk 22 and the first mating member 28 has a first cutout 30 extending to the second surface 26. The first cutout 30 has a bounding edge 32 and the bounding edge 32 has a plurality of intersecting sides 34 such that the first cutout 30 has a rectangular shape.

A ball 36 is provided and the ball 36 may contain a billiard chalk 38 thereby facilitating a billiard cue 40 to be chalked. The ball 36 is removably coupled to the bracelet 12 to facilitate the billiard chalk 38 to be accessible to a wearer 42 of the bracelet 12. The ball 36 has a bottom side 44 and a top side 46. The bottom side 44 is flattened and the top side 46 is concavely arcuate with respect to the bottom side 44. Indicia 48 may be printed on the top side 46 and the indicia 48 may comprise the number "8". In this way the ball 36 may have the ornamental appearance of an 8-ball 36 associated with the game of billiards.

The bottom side 44 has a well 50 extending into the ball 36 and the well 50 insertably receives the billiard chalk 38. A second mating member 52 is coupled to the bottom side 44 of the ball 36. The second mating member 52 has a second cutout 54 extending to the bottom side 44 and the second cutout 54 is aligned with the well 50. In this way the second mating member 52 is does not impede inserting the billiard chalk 38 into the well 50. The second mating member 52 is matable to the first mating member 28 to retain the ball 36 on the bracelet 12. Additionally, the first cutout 30 is aligned with the billiard chalk 38 when the ball 36 is removably coupled to the bracelet 12. Each of the first and second 52 mating members may comprise complementary hook and loop fasteners or the like.

In use, the billiard chalk 38 is inserted into the well 50 and the ball 36 is removably coupled to the bracelet 12. The bracelet 12 is worn during billiard game play. In this way the billiard chalk 38 is continuously accessible to the wearer 42 of the bracelet 12. The ball 36 is removed from the bracelet 12 and the billiard chalk 38 is selectively manipulated in the convention of applying billiard chalk 38 to a billiard cue 40. Moreover, the billiard chalk 38 is replaced when the billiard chalk 38 is depleted.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A billiard chalking assembly being configured to be worn around a wrist, said assembly comprising:

a bracelet being configured to be worn around a wrist, said bracelet having a first end, a second end and a first surface extending therebetween, said bracelet being curved between said first end and said second end having said first end being spaced from said second end;

a disk having a first surface and a second surface, said first surface of said disk being coupled to said first surface of said bracelet, said disk being centrally positioned between said first end and said second end;

a first mating member being coupled to said second surface of said disk;

a ball being configured to contain a billiard chalk thereby facilitating a billiard cue to be chalked, said ball being removably coupled to said bracelet thereby facilitating the billiard chalk to be accessible to a wearer of said bracelet;

a well extending into said ball, said well being configured to insertably receive the billiard chalk; and a second mating member being coupled to said ball, said second mating member extending around said well, said second mating member being matable to said first mating member such that said ball is retained on said bracelet and said well is covered by said bracelet wherein said bracelet is configured for covering the billiard chalk while said ball is coupled to said bracelet.

2. The assembly according to claim 1, further comprising said first mating member having a first cutout extending to said second surface, said first cutout having a bounding edge, said bounding edge having a plurality of intersecting sides such that said first cutout has a rectangular shape.

3. The assembly according to claim 1, wherein said ball has a bottom side and a top side, said bottom side being flattened, said top side being concavely arcuate with respect to said bottom side, said bottom side having said well extending into said ball.

4. The assembly according to claim 3, further comprising said second mating member being coupled to said bottom side of said ball, said second mating member having a second cutout extending to said bottom side, said second cutout being aligned with said well.

5. A billiard chalking assembly being configured to be worn around a wrist, said assembly comprising:

a bracelet being configured to be worn around a wrist, said bracelet having a first end, a second end and a first surface extending therebetween, said bracelet being curved between said first end and said second end having said first end being spaced from said second end;

a disk having a first surface and a second surface, said first surface of said disk being coupled to said first surface of said bracelet, said disk being centrally positioned between said first end and said second end;

a first mating member being coupled to said second surface of said disk, said first mating member having a first cutout extending to said second surface, said first cutout having a bounding edge, said bounding edge having a plurality of intersecting sides such that said first cutout has a rectangular shape;

a ball being configured to contain a billiard chalk thereby facilitating a billiard cue to be chalked, said ball being removably coupled to said bracelet thereby facilitating the billiard chalk to be accessible to a wearer of said bracelet, said ball having a bottom side and a top side, said bottom side being flattened, said top side being concavely arcuate with respect to said bottom side, said bottom side having a well extending into said ball, said well being configured to insertably receive the billiard chalk; and a second mating member being coupled to said bottom side of said ball, said second mating member having a second cutout extending to said bottom side, said second cutout being aligned with said well wherein said second mating member extends around said well, said second mating member being matable to said first mating member such that said ball is retained on said bracelet and said well is covered by said bracelet wherein said bracelet is configured for covering the billiard chalk while said ball is coupled to said bracelet.

* * * * *